US005947774A

United States Patent [19]

Abe

[11] Patent Number: 5,947,774

[45] Date of Patent: Sep. 7, 1999

[54] PRESS-CONNECTING CONNECTOR

[75] Inventor: Kimihiro Abe, Shizuoka, Japan

[73] Assignee: Yazaki Corporation, Tokyo, Japan

[21] Appl. No.: 08/927,531

[22] Filed: Sep. 11, 1997

[30] Foreign Application Priority Data

Sep. 13, 1996 [JP] Japan ..... 8-243639
Sep. 13, 1996 [JP] Japan ..... 8-243652

[51] Int. Cl.[6] ..... H01R 13/502

[52] U.S. Cl. ..... 439/701; 439/752

[58] Field of Search ..... 439/701, 708, 439/709, 717, 752, 714, 595

[56] References Cited

U.S. PATENT DOCUMENTS 3,848,951 11/1974 Michaels et al. ..... 439/701 X
4,484,792 11/1984 Tengler et al. ..... 439/701 X

FOREIGN PATENT DOCUMENTS 55-93979 6/1980 Japan .
62-26869 2/1987 Japan .

*Primary Examiner*—Khiem Nguyen
*Attorney, Agent, or Firm*—Sughrue, Mion, Zinn, Macpeak & Seas PLLC

[57] ABSTRACT

A press-connecting connector includes a plurality of housings each having a bottom wall and a plurality of partition walls extending substantially perpendicularly from the bottom wall, in which the housings are combinable together in such a manner that the partition walls of one of any two adjacent housings are opposed respectively to the partition walls of the other housing so as to form terminal receiving chambers respectively receivable press-connecting terminals. First opposing end portions are formed on the partition walls of the one housing, and second opposing end portions formed on the partition walls of the other housing. The first opposing end portions may be abutted respectively to the second opposing end portions in an intimately-contacted condition when the housings are combined together. Also, the first and second opposing end portions may be combined together so formed as to be engaged with each other when the housings are combined together.

12 Claims, 6 Drawing Sheets

PRESS-CONNECTING CONNECTOR

BACKGROUND OF THE INVENTION

Field of the Invention

This invention relates to a press-connecting connector receivable press-connecting terminals therein.

Background

A press-connecting terminal has press-connecting blades which bite into an insulating sheath of a wire, and contacts a conductor in the insulating sheath, thereby making an electrical connection between the press-connecting terminal and the wire. FIG. 4 shows a conventional press-connecting connector having press-connecting terminals received therein. The press-connecting connector includes a housing 1 made of an insulating resin. The housing 1 includes a bottom wall 2, a plurality of partition walls 3 which are formed at predetermined intervals on the bottom wall 2, and extend upwardly from the bottom wall 2, and a plurality of terminal receiving chambers 4. Each of the terminal receiving chambers 4 is surrounded with the bottom wall 2 and each adjacent partition walls 3, and is formed in the housing 1 to be receivable each of press-connecting terminals 5.

The press-connecting terminals 5 each includes a hollow contact portion 6, into which a mating terminal (not shown) is insertable to electrically contact this contact portion 6, and press-connecting portions 8 connected to the contact portion 6 through a bottom portion 7. The press-connecting portions 8 extend upwardly respectively from opposite side edges of the bottom portion 7, and are disposed in opposed relation to each other. Each of the press-connecting portions 8 is formed to have a channel-shaped cross-section, and opposite bent end portions of the press-connecting portion 8 serve respectively as press-connecting blades 9 which bite into a wire 10. The wire 10 has a conductor 11 covered with an insulating sheath 12.

In this construction, the wire 10 is positioned above the press-connecting terminal 5 to be disposed in registry with the space between the press-connecting portions 8. Then, a press-connecting jig (not shown) is moved downwardly to press the wire 10 into the space between the press-connecting portions 8. Accordingly, the press-connecting blades 9 bite into the insulating sheath 12 to contact the conductor 12, thereby connecting the press-connecting terminal to the wire 10.

In order to enable this pressing operation by the press-connecting jig, the upper side of the housing 1 need to be open. In the conventional construction, a cover 13, which is generally in the form of a flat plate, is put on the upper side of the housing 1, thereby closing the upper sides of the terminal receiving chambers 4 with this cover 13.

In the press-connecting connector of the conventional construction in which the cover 13 is merely put on the housing 1, dew condensation is liable to develop within the terminal receiving chambers 4, and the production of dew condensation invites the possibility of an electric leakage. More specifically, when the cover 13 is merely put on the housing 1, a gap 14 is formed between each of the partition walls 3 of the housing 1 and the cover 13 as shown in FIG. 5, so that there is a possibility that moisture intrudes into the interiors of the terminal receiving chambers 4 through these gaps 14.

SUMMARY OF THE INVENTION

This invention has been made in view of the problem of the conventional construction, and an object of the invention is to provide a press-connecting connector in which dew condensation is positively prevented from developing within terminal receiving chambers.

In order to achieve the above object, according to a first aspect of the invention, there is provided a press-connecting connector including a plurality of housings each having a bottom wall and a plurality of partition walls extending substantially perpendicularly from the bottom wall, in which the housings are combinable together in such a manner that the partition walls of one of any two adjacent housings are opposed respectively to the partition walls of the other housing, thereby forming terminal receiving chambers respectively receivable press-connecting terminals; opposing end portions of the partition walls of the one housing are abutted respectively to opposing end portions of the partition walls of the other housing in an intimately-contacted condition.

In this construction, when the housings are combined together in such a manner that the partition walls of the one housing are opposed respectively to the partition walls of the other housing, the plurality of terminal receiving chambers, separated from one another by the partition walls, are formed. At this time, the opposing end portions of the opposed partition walls are abutted together in an intimately-contacted condition, and therefore moisture and rain water are positively shut off, and will not intrude into the terminal receiving chambers via the partition walls, thereby positively preventing dew condensation.

In a second aspect of the invention according to the first aspect, the opposing end portions of the partition walls of the one housing are abutted respectively against the opposing end portions of the partition walls of the other housing, and are formed into such a configuration that they can be deformed by this abutment.

The opposing end portion of each partition wall of the one housing is crushed, so that an intimate contact area is formed between this opposing end portion and the opposing end portion of the partition wall of the other housing, thereby shutting off moisture and rain water more positively.

In a third aspect of the invention according to the second aspect, the opposing end portions of the partition walls of the one housing are tapering respectively toward the opposing end portions of the partition walls of the other housing.

Because of this tapering configuration, the opposing end portion, when abutted against the mating opposing end portion, can be positively crushed.

According to a fourth aspect of the invention, there is provided a press-connecting connector including a plurality of housings each having a bottom wall and a plurality of partition walls extending substantially perpendicularly from the bottom wall, in which the housings are combinable together in such a manner that the partition walls of one of any two adjacent housings are opposed respectively to the partition walls of the other housing, thereby forming terminal receiving chambers respectively receivable press-connecting terminals; opposing end portions of the partition walls of the housings to be combined together are so formed as to be engaged with each other.

Also, the first and second opposing end portions are so formed as to be partially lapped each other when the housings are combined together.

In this construction, when the housings are combined together in such a manner that the partition walls of the one housing are opposed respectively to the partition walls of the other housing, the plurality of terminal receiving chambers, separated from one another by the partition walls, are formed. The opposing end portions of the opposed partition walls are interlocked, and therefore the creeping distance up to the adjacent terminal receiving chamber is increased. Therefore, moisture and rain water are less liable to intrude into the terminal receiving chambers, thereby preventing dew condensation. When the opposing end portions of the partition walls are engaged respectively with the opposing end portions of the corresponding partition walls, the displacement of the housings with respect to each other is prevented.

In a fifth aspect of the invention according to the fourth aspect, a concave portion is formed in the opposing end portion of each partition wall of the one housing, and the opposing end portion of the partition wall of the other housing is inserted into this concave portion.

The opposing end portion of the partition wall of the other housing is thus fitted in the concave portion, so that the mating opposing end portions are interlocked, and therefore the increased creeping distance can be obtained.

In a sixth aspect of the invention according to the fourth aspect, the opposing end portions of the partition walls of the housings to be combined together are so formed as to be engaged with each other in a stepped configuration.

In this case where the opposing end portions of the partition walls are interlocked in a stepped configuration, the increased creeping distance can be obtained.

DETAILED DESCRIPTION OF THE PREFERRED EMBODIMENTS

First Embodiment

Figure 1:
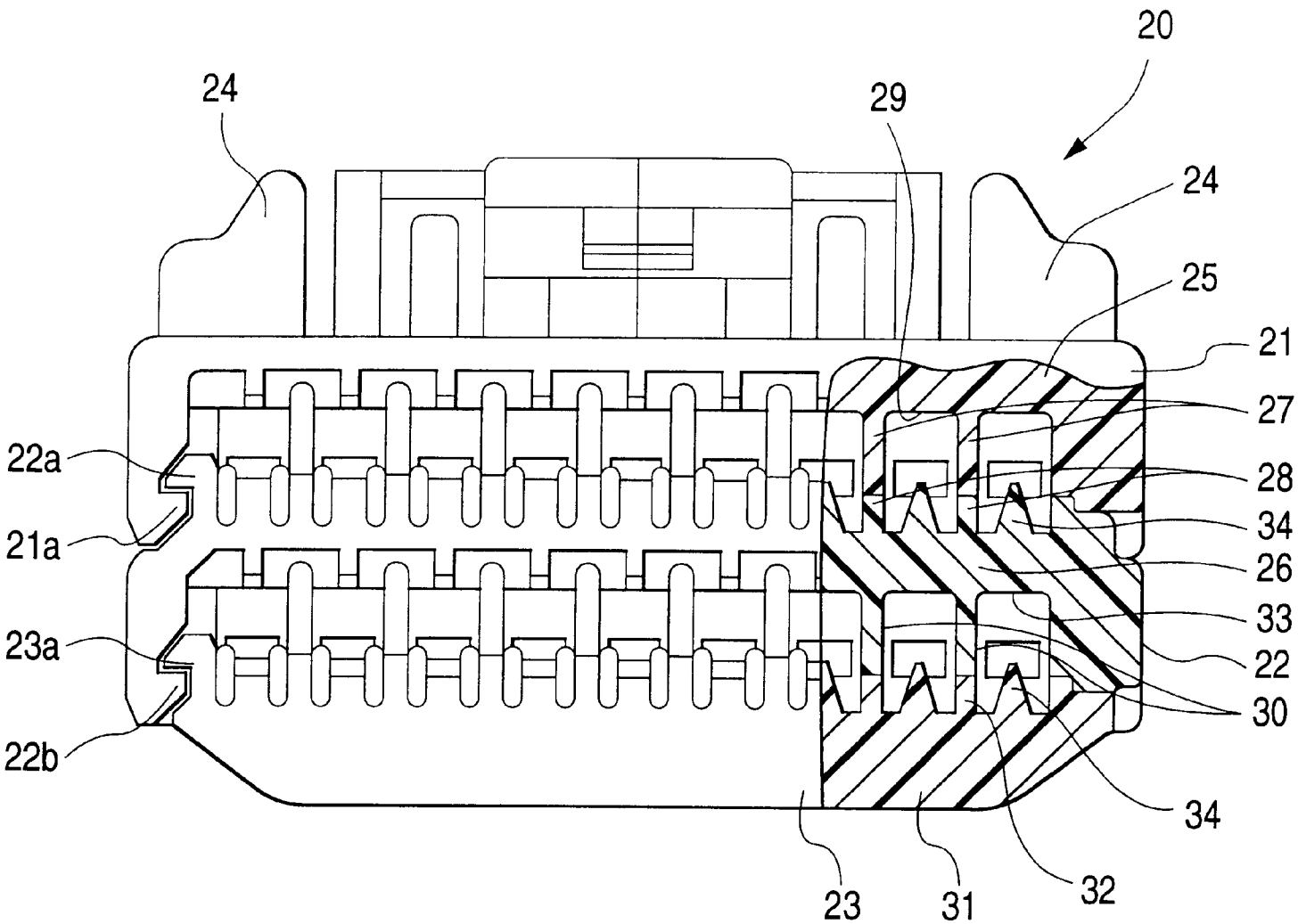
FIG. 1 is a partly-broken, front-elevational view of a press-connecting connector of the present invention, showing an overall construction thereof.
Figure 2:
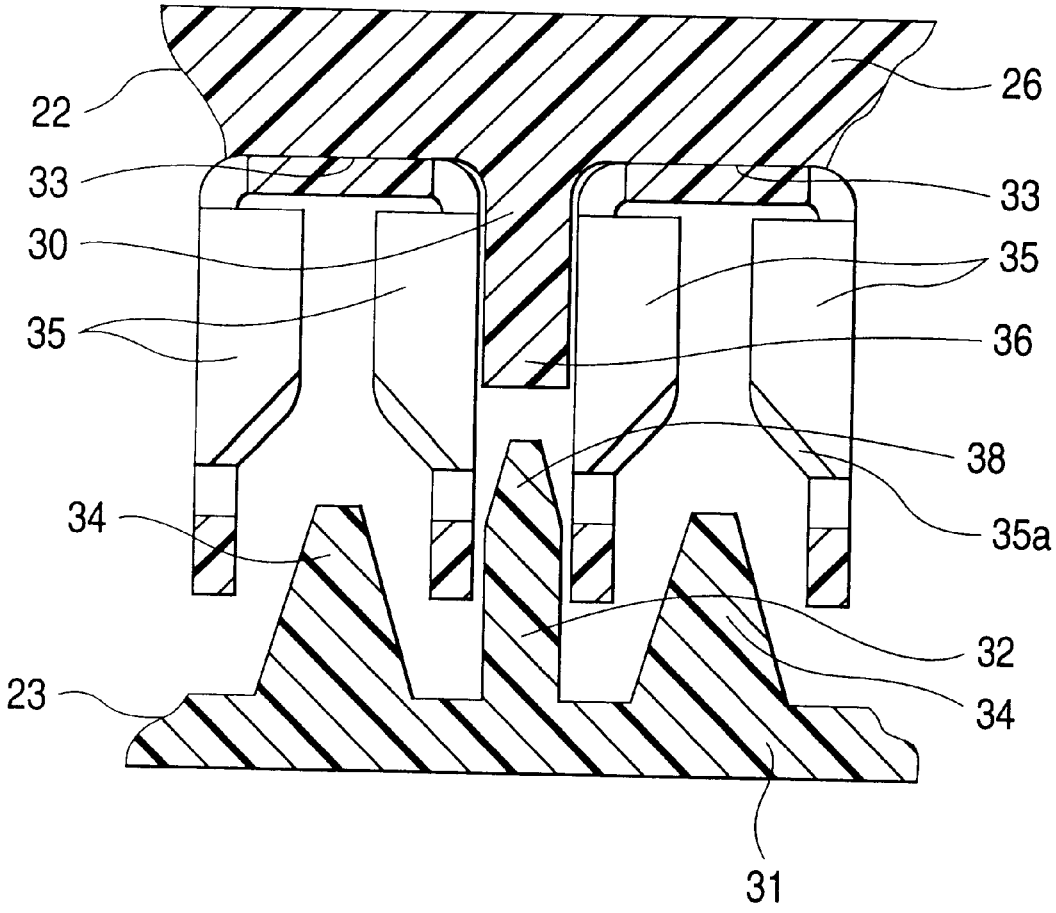
FIG. 2 is a cross-sectional view of an important portion of a first embodiment.

FIG. 1 is a partly-broken, front-elevational view of a first preferred embodiment of the present invention, showing an overall construction thereof, and FIG. 2 is a cross-sectional view of an important portion the first preferred embodiment.

A press-connecting connector 20 includes three housings which are combined together in a vertical direction. Reference numeral 21 denotes the upper housing located at an uppermost position, reference numeral 22 the lower housing located at an intermediate position, reference numeral 23 the cover housing located at a lowermost position.

Hook portions 21*a*, 22*a*, 22*b* and 23*a* are formed respectively at opposed portions of opposite ends of these housings 21, 22 and 23, and the press-connecting connector 20 is assembled by engaging these hook portions with one another. More specifically, the hook portions 21*a* of the upper housing 21 are engaged respectively with the hook portions 22*a* of the lower housing 22, and the hook portions 23*a* of the cover housing 23 are engaged respectively with the hook portions 22*b* of the lower housing 22 which are connected respectively to the hook portions 22*a*, and through these engagements, the housings 21, 22 and 23 are combined together to form the press-connecting connector 20. Therefore, in this embodiment, the upper housing 21 and the lower housing 22 are the mating housings with respect to each other, and the lower housing 22 and the cover housing 23 are the mating housings with respect to each other.

The upper housing 21 and the lower housing 22 have bottom walls 25 and 26, respectively, which extend longer in their widthwise direction, and a plurality of partition walls 27, 28 are formed at predetermined intervals on the bottom wall 25, 26, and extend perpendicularly therefrom toward the mating housing. The partition walls 27 of the housing 21 are opposed respectively to the partition walls 28 of the housing 22, and when the housings 21 and 22 are combined together, the partition walls 27, opposed respectively to the partition walls 28, are abutted respectively against the partition walls 28. A plurality of terminal receiving chambers 29 are formed by the partition walls 27 and 28 and the bottom walls 25 and 26.

A similar arrangement is provided for the lower housing 22 and the cover housing 23, and partition walls 30 extend perpendicularly from the bottom wall 26 of the lower housing 22 toward the cover housing 23. The cover housing 23 has a bottom wall 31 extending longer in its widthwise direction, and a plurality of partition walls 32 extend perpendicularly from the bottom wall 31 toward the lower housing 22. When the housings 22 and 23 are combined together, a plurality of terminal receiving chambers 33 are formed by the partition walls 30 and 32 and the bottom walls 26 and 31.

Push-up projections 34 are formed on the lower one (the lower housing 22, the cover housing 23) of any two housings (among the housings 21, 22 and 23) to be combined together, and extend perpendicularly toward the mating housing 21, 22. The push-up projections 34 are so formed as to be opposed respectively to the terminal receiving chambers 29, 33, and when the housings are combined together, each of the push-up projections 34 causes a wire to be press-connected to a press-connecting terminal (described later).

Figure 4:
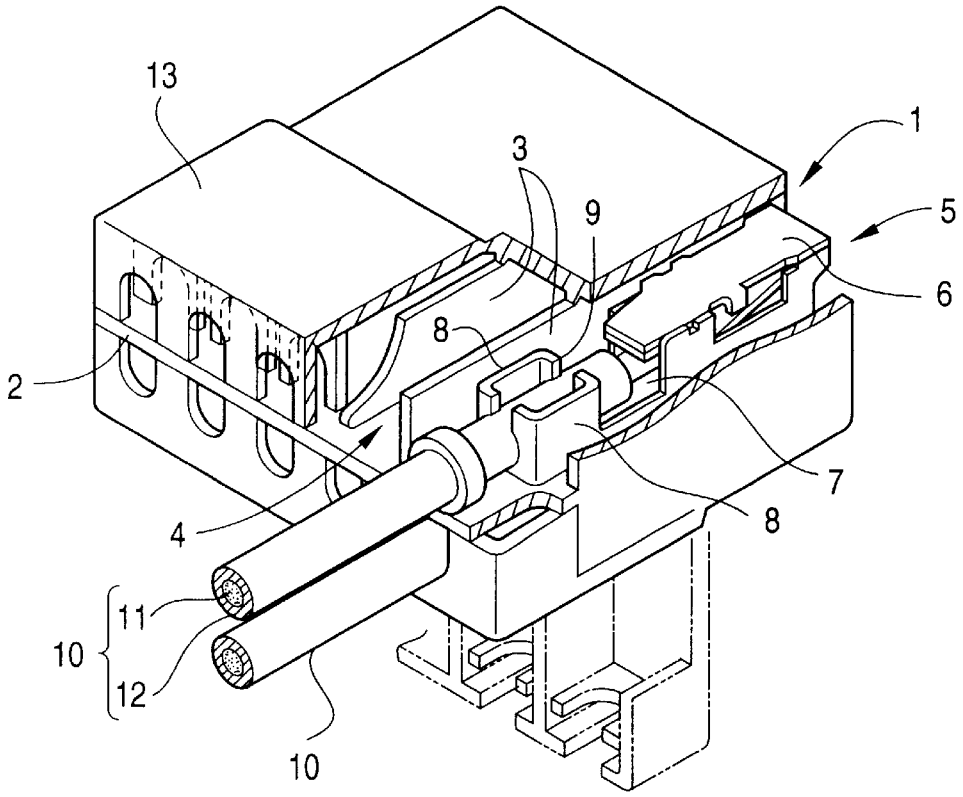
FIG. 4 PRIOR ART
FIG. 4 is a partly-broken, perspective view of a conventional press-connecting connector.
Figure 5:
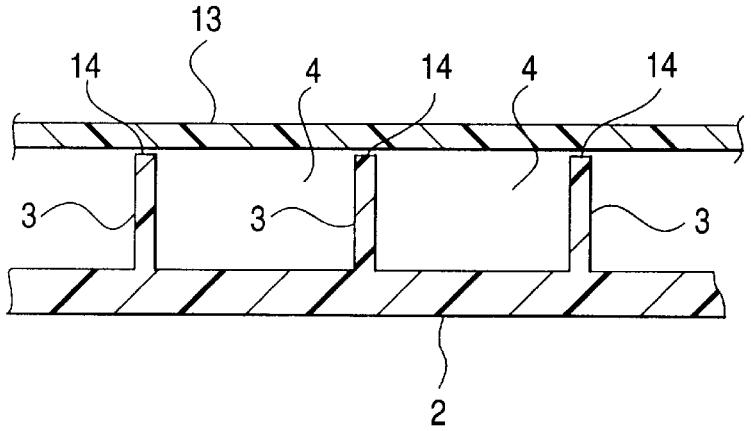
FIG. 5 PRIOR ART
FIG. 5 is a cross-sectional view showing a problem with the press-connecting connector.

In the first embodiment, the terminal receiving chambers 29 and 33 are arranged in two (upper and lower) rows, and each row of terminal receiving chambers are arranged in the widthwise direction. As shown in FIG. 2, the press-connecting terminal is insertable into each of the terminal receiving chambers 29 and 33. The press-connecting terminal is similar in construction to that shown in FIG. 4, and has press-connecting blades 35 for biting into the wire, and each blade 35 has a downwardly-slanting blade portion 35*a*, as shown in FIG. 2.

Figure 3:
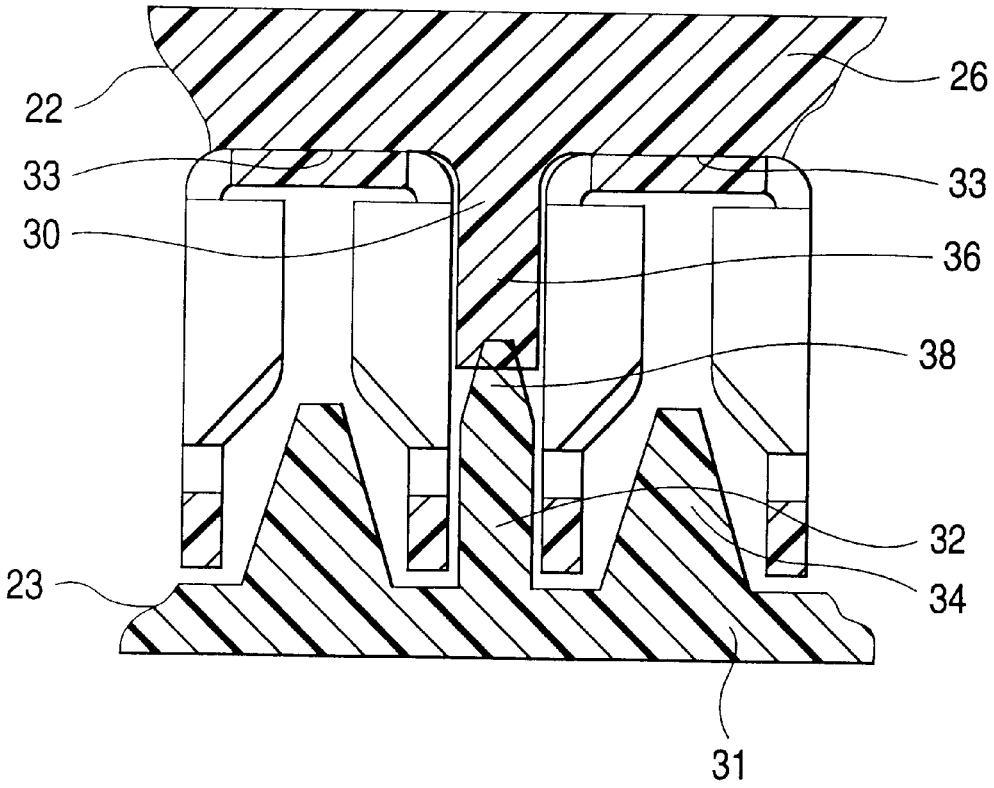
FIG. 3 is a cross-sectional view showing a combined condition of the first embodiment.

In this embodiment, when the housings are combined together, the opposing end portions of the partition walls are abutted together in an intimately-contacted condition. FIGS. 2 and 3 show this relation with respect to the lower housing 22 and the cover housing 23.

The opposing end portions 36 of the partition walls 30 of the lower housing 22 are opposed respectively to the opposing end portions 38 of the partition walls 32 of the cover housing 23. The partition wall 32 of the cover housing 23 is smaller in thickness than the partition wall 30 of the lower housing 22. The partition wall 30 of the lower housing 22 has a uniform thickness over the entire length thereof whereas the opposing end portion 38 of the partition wall 32 is tapering toward the lower housing 22. Because of this tapering configuration, the opposing end portion 38 of the partition wall 32 of the cover housing 23 is lower in strength than the opposing end portion 36 of the partition wall of the lower housing 22.

The sum of the lengths of the partition walls 30 and 32 is slightly larger than the predetermined spacing between the housings 22 and 23 combined together. Therefore, when the housings 22 and 23 are combined together, the opposing end portions 36 and 38 are abutted against each other, and also overlap each other in an amount corresponding to the difference between the above sum and the above predetermined spacing.

In this relation, the wire is placed on each push-up projection 34, and one of the housings 22 and 23 is moved toward the other by a press-connecting jig, thereby causing the press-connecting blades 35 to bite into the wire. At an initial stage of this combining operation, the partition walls 30 and 32 move toward each other as shown in FIG. 2.

Then, when the housings 22 and 23 are further moved toward each other so as to engage the hook portions 22*b* respectively with the hook portions 23*a*, the opposing end portions 36 of the partition walls 30 are abutted respectively against the opposing end portions 38 of the partition walls 32. In this abutting operation, the opposing end portion 38 of the partition wall 32 is crushed since the opposing end portion 38 of the partition wall 32 is lower in strength than the opposing end portion 36 of the partition wall 30, and as a result of this crushing, the opposing end portions 36 and 38 are held in intimate contact with each other over a wide contact area, as shown in FIG. 3.

When the opposing end portions 36 and 38 are thus held in intimate contact with each other, no gap is present between the partition walls 30 and 32, thereby positively shutting off moisture and rain water. Therefore, moisture and rain water will not intrude into the terminal receiving chambers 33, and an electric leakage due to these is prevented.

The above construction of the opposing end portions is applied also to the partition walls 27 of the upper housing 21 and the partition walls 28 of the lower housing 22, and with this construction dew condensation within the terminal receiving chambers 29 in the upper row is prevented in a similar manner as described above.

The above intimate contact due to the crushing can be achieved by the relation of the strength between the opposing end portions, and therefore a small hole or a number of slits may be formed in the opposing end portion of one of the partition walls to be abutted together.

Second Embodiment

Figure 6:
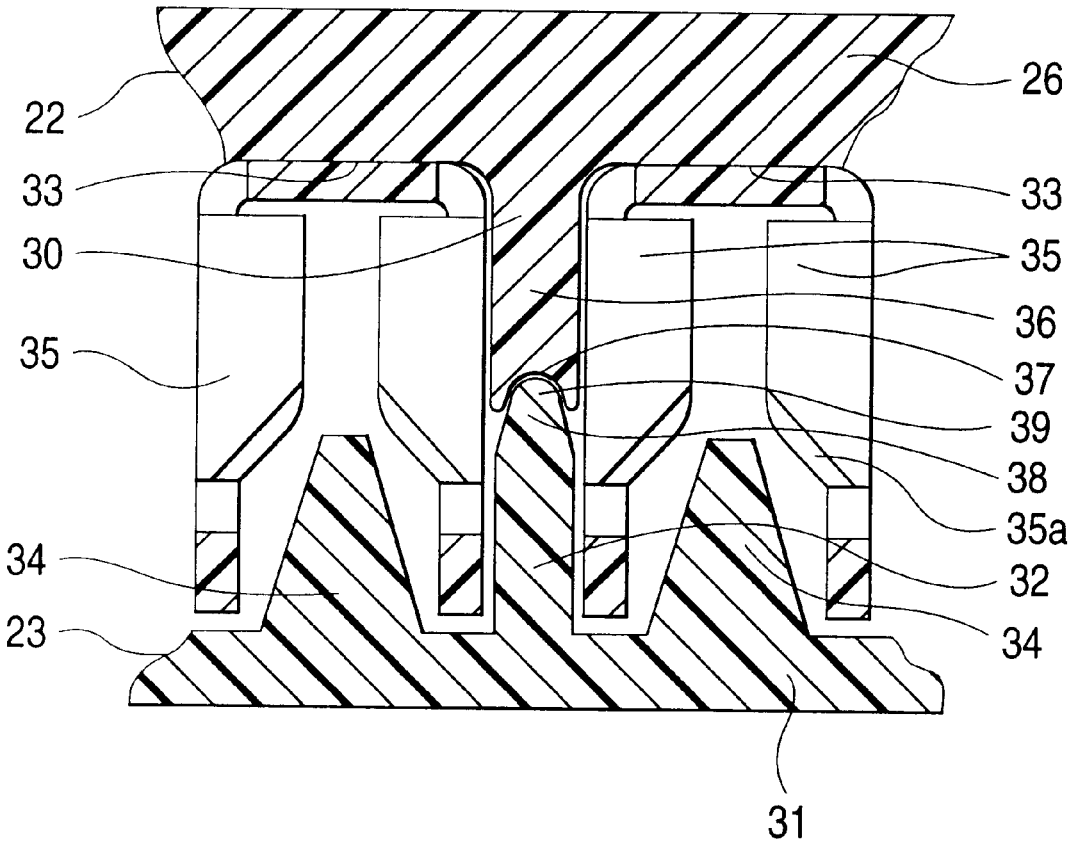
FIG. 6 is a cross-sectional view of an important portion of a second embodiment.

FIG. 6 shows a second embodiment of the present invention. In the second embodiment, opposing end portions of partition walls of mating housings are so formed as to be engaged with each other. FIG. 6 shows this engagement with respect to a lower housing 22 and a cover housing 23.

Lengths of partition walls 30 and 32 of the housings 22 and 23 are so determined that the partition walls 30 and 32 can be abutted against each other. An opposing end portion 36 of each partition wall 30 of the lower housing 22 is recessed in arcuate at its central portion to provide a concave portion 37. On the other hand, an opposing end portion 38 of each partition wall 32 of the cover housing 23 is formed into a tapering, convex portion 39, and can be fitted into the concave portion 37 of the lower housing 22.

When the housings 22 and 23 are combined together, each convex portion 39 is inserted and fitted into the associated concave portion 37, so that the opposing end portions 36 and 38 of the partition walls 30 and 32 are interlocked. In this engaged condition, the creeping distance up to the adjacent terminal receiving chamber 33 is increased, so that moisture and rain water are less liable to intrude into the terminal receiving chambers 33. Therefore, dew condensation within the terminal receiving chambers 33 is prevented, and an electric leakage due to such dew condensation is prevented. And besides, since the opposing end portions 36 and 38 are interlocked, the partition walls 30 and 32 are firmly connected together. Therefore, the displacement of the housings 22 and 23 with respect to each other is prevented.

Third Embodiment

Figure 7:
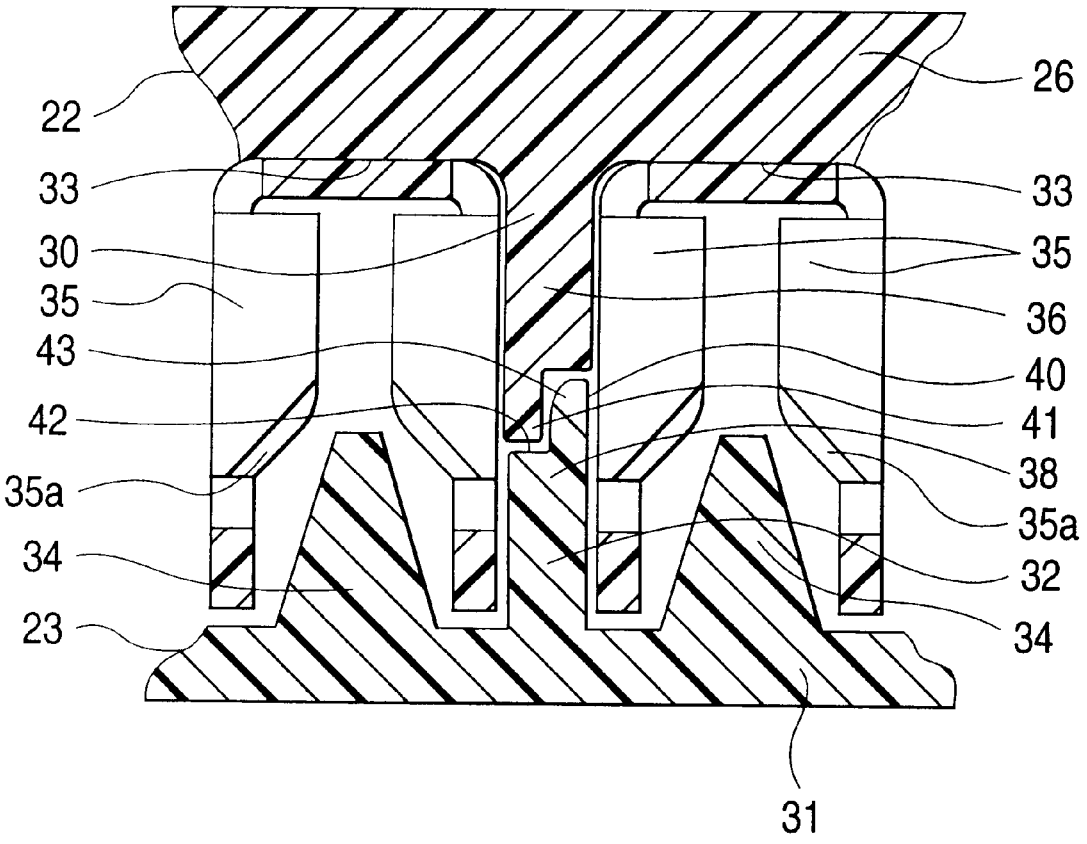
FIG. 7 is a cross-sectional view of an important portion of a third embodiment.

FIG. 7 shows a lower housing 22 and a cover housing 23 in a third embodiment of the present invention. An opposing end portion 36 of each partition wall 30 of the lower housing 22 is formed into a stepped configuration having a lower portion 40 and a higher portion 41. Also, an opposing end portion 38 of each partition wall 32 of the cover housing 23 is formed into a stepped configuration having a lower portion 42 and a higher portion 43. The lower portions 40 and 42 of the opposing end portions 36 and 38 are opposed respectively to the higher portions 43 and 41 of the opposing end portions 38 and 36. Therefore, when the housings 22 and 23 are combined together, the opposing end portions 36 and 38 are interlocked, and the creeping distance up to the adjacent terminal receiving chamber 33 is increased. Accordingly, the intrusion of moisture and rain water is prevented.

The above construction of the opposing end portions is applied also to partition walls 27 of an upper housing 21 and partition walls 28 of the lower housing 22, and with this construction dew condensation within terminal receiving chambers 29 in an upper row is prevented in a similar manner as described above.

In the first embodiment, when the housings are combined together in such a manner that the partition walls are opposed respectively to the corresponding partition walls, the plurality of terminal receiving chambers, separated from one another by the partition walls, are formed. At this time, the opposing end portions of the opposed partition walls are abutted together in an intimately-contacted condition, and therefore moisture and rain water are positively shut off, and will not intrude into the terminal receiving chambers via the partition walls, thereby positively preventing dew condensation.

As a result of the abutment of the partition walls against each other, the opposing end portion of one of the mating partition walls is crushed, so that the intimate contact area is formed between this opposing end portion and the opposing end portion of the other partition wall, thereby shutting off moisture and rain water more positively.

The opposing end portion of the partition wall of one of the mating housings is formed into a tapering configuration, and is reduced in strength, and therefore can be positively crushed when the partition walls are abutted together.

In the second and third embodiments, when the housings are combined together in such a manner that the partition walls are opposed respectively to the corresponding partition walls, the plurality of terminal receiving chambers, separated from one another by the partition walls, are formed. In this condition in which the housings are combined together, the opposing end portions of the opposed partition walls are engaged together, and therefore the creeping distance up to the adjacent terminal receiving chamber is increased. Therefore, moisture and rain water are less liable to intrude into the terminal receiving chambers, thereby preventing dew condensation.

The opposing end portion of the partition wall of one of the mating housings is inserted into the concave portion of the partition wall of the other housing, so that the opposing end portions are interlocked, and therefore the increased creeping distance can be obtained.

The opposing end portions, opposed to each other, are interlocked in a stepped manner, and therefore the increased creeping distance can be obtained.

What is claimed is:

1. A press-connecting connector, comprising:

a plurality of housings each including a bottom wall and a plurality of partition walls extending substantially perpendicularly from the bottom wall, wherein the housings are combinable together in such a manner that the partition walls of one of any two adjacent housings are opposed respectively to the partition walls of the other housing so as to form terminal receiving chambers respectively separated by said partition walls for receiving press-connecting terminals;

first opposing end portions formed on the partition walls of the one housing; and second opposing end portions formed on the partition walls of the other housing, wherein the first opposing end portions are abutted respectively against the second opposing end portions in an intimately-contacted condition when the housings are combined together.

2. The press-connecting connector of claim 1, wherein the first opposing end portions have a configuration that they can be deformed, when the first opposing end portions are abutted respectively against the second opposing end portions, so as to provide an intimate contact between the first opposing end portions and the second opposing end portions.

3. The press-connecting connector of claim 2, wherein the first opposing end portions are tapered respectively toward the second opposing end portions.

4. A press-connecting connector, comprising:

a plurality of housings each including a bottom wall and a plurality of partition walls extending substantially perpendicularly from the bottom wall, wherein the housings are combinable together in such a manner that the partition walls of one of any two adjacent housings are opposed respectively to the partition walls of the other housing so as to form terminal receiving chambers respectively separated by said partition walls for receiving press-connecting terminals;

first opposing end portions formed on the partition walls of the one housing; and second opposing end portions formed on the partition walls of the other housing, wherein the first and second opposing end portions are so formed as to be intimately engaged when the housings are combined together.

5. The press-connecting connector of claim 4, further comprising a concave portion formed in each of the first opposing end portion, wherein each of the second opposing end portion is insertable into the concave portion when the housings are combined together.

6. The press-connecting connector of claim 4, wherein the first and second opposing end portions to be combined together are so formed as to be engaged with each other in a stepped configuration.

7. The press-connecting connector of claim 4, wherein the first and second opposing end portions are so formed as to be partially lapped each other when the housings are combined together.

8. A press-connecting connector, comprising:

a plurality of housings each including a bottom wall and a plurality of partition walls extending substantially perpendicularly from the bottom wall, wherein the housings are combinable together in such a manner that the partition walls of one of any two adjacent housings are opposed respectively to the partition walls of the other housing so as to form terminal receiving chambers respectively separated by said partition walls for receiving press-connecting terminals;

first opposing end portions formed on the partition walls of the one housing; and second opposing end portions formed on the partition walls of the other housing, wherein the first and second opposing end portions have portions partially lapped and intimately contacting each other when the housings are combined together.

9. The press-connecting connector of claim 8, further comprising a concave portion formed in each of the first opposing end portion, wherein each of the second opposing end portion is insertable into the concave portion when the housings are combined together.

10. The press-connecting connector of claim 8, wherein the first and second opposing end portions to be combined together are so formed as to be engaged with each other in a stepped configuration.

11. A press-connecting connector, comprising:

a plurality of housings each including a bottom wall and a plurality of partition walls extending substantially perpendicularly from the bottom wall, wherein the housings are combinable together in such a manner that the partition walls of one of any two adjacent housings are opposed respectively to the partition walls of the other housing so as to form terminal receiving chambers respectively separated by said partition walls for receiving press-connecting terminals;

first opposing end portions formed on the partition walls of the one housing; and second opposing end portions formed on the partition walls of the other housing, wherein the first and second opposing end portions are so formed as to be engaged when the housings are combined together, and wherein a concave portion is formed in each of the first opposing end portions, and each of the second opposing end portions is insertable into the concave portion when the housings are combined together.

12. A press-connecting connector, comprising:

a plurality of housings each including a bottom wall and a plurality of partition walls extending substantially perpendicularly from the bottom wall, wherein the housings are combinable together in such a manner that the partition walls of one of any two adjacent housings are opposed respectively to the partition walls of the other housing so as to form terminal receiving chambers respectively separated by said partition walls for receiving press-connecting terminals;

first opposing end portions formed on the partition walls of the one housing; and second opposing end portions formed on the partition walls of the other housing, wherein the first and second opposing end portions have portions partially lapped and contacting each other when the housings are combined together, and wherein a concave portion is formed in each of the first opposing end portions, and each of the second opposing end portions is insertable into the concave portion when the housings are combined together.

* * * * *